US005774956A

United States Patent [19]

French et al.

[11] Patent Number: 5,774,956

[45] Date of Patent: Jul. 7, 1998

[54] HIGH-SECURITY BUCKLE

[75] Inventors: John M. French, Duarte, Calif.; Johannes G. F. Wigger, Lutte, Netherlands

[73] Assignee: Michaels of Oregon Co., Portland, Oreg.

[21] Appl. No.: 788,743

[22] Filed: Jan. 24, 1997

[51] Int. Cl.[6] ..... A44B 11/00

[52] U.S. Cl. ..... 24/625; 24/616; 24/633

[58] Field of Search ..... 24/604, 614–618, 24/625, 633

[56] References Cited

U.S. PATENT DOCUMENTS

| | | | |
|---|---|---|---|
| D. 289,622 | 5/1987 | Crowle et al. | 11/216 |
| D. 296,310 | 6/1988 | Crowle | 11/216 |
| 874,957 | 12/1907 | Godley . | |
| 3,812,556 | 5/1974 | Colombo | 24/230 |
| 4,398,324 | 8/1983 | Bakker et al. | 24/230 |
| 4,793,032 | 12/1988 | Crowle | 24/615 |
| 4,825,515 | 5/1989 | Wolterstorff, Jr. | 24/625 |
| 4,912,950 | 4/1990 | Crowle | 70/58 |
| 4,930,324 | 6/1990 | Meier | 70/18 |
| 5,144,725 | 9/1992 | Krauss | 24/625 |
| 5,222,279 | 6/1993 | Frano et al. | 24/625 |
| 5,237,728 | 8/1993 | Fudaki | 24/614 |
| 5,383,257 | 1/1995 | Krauss | 24/625 |
| 5,398,390 | 3/1995 | Hede et al. | 24/616 |
| 5,440,792 | 8/1995 | Ida | 24/625 X |
| 5,465,472 | 11/1995 | Matoba | 24/625 |
| 5,471,716 | 12/1995 | Takahashi | 24/625 X |
| 5,507,076 | 4/1996 | Ansher | 24/625 |
| 5,551,131 | 9/1996 | Anscher | 24/614 |
| 5,584,105 | 12/1996 | Krauss | 24/625 X |
| 5,590,444 | 1/1997 | Krauss | 24/625 |

*Primary Examiner*—Peter M. Cuomo
*Assistant Examiner*—Robert J. Sandy
*Attorney, Agent, or Firm*—Chernoff, Vilhauer, McClung & Stenzel

[57] ABSTRACT

A high-security buckle including a pair of flexible side release latches and a third latch accessible on the front of the buckle. A male part of the buckle fits within a tubular body of a female part of the buckle. Disengagement of the male part can be accomplished by squeezing the side release latch catch bodies toward each other while pressing the third catch body into the body of the female part far enough for all three latches to be disengaged simultaneously.

7 Claims, 3 Drawing Sheets

HIGH-SECURITY BUCKLE

BACKGROUND OF THE INVENTION

The present invention relates to buckles, and in particular to a buckle having a female receptacle part and a corresponding male part which fits into the female receptacle and is releasably latched in place, yet is resistant to accidental release.

Web belts are commonly fastened by the use of side release buckles made of molded plastics. Such buckles can be made of ample strength to carry the loads likely to be imposed on the web belts by items such as backpacks, holsters, fanny packs, and other luggage, but with many of the previously available side release buckles it is possible for one side of the buckle to become disengaged accidentally, leaving the buckle easily susceptible to being unfastened fully or even breaking.

Side release buckles are used to fasten holster belts or other equipment belts or harnesses used by law enforcement or military personnel, where under some conditions the buckles may be subjected to pressure from equipment being carried, or may be pressed against the wearer's body or exposed to contact with nearby objects as a result of strenuous activities of the wearer. Under such extreme conditions it is quite easily possible that side release buckles could be subjected to pressure against at least one of the side release bodies, releasing one of the latches. Thus, with only one of the two side release latches remaining engaged, the other might easily be disengaged or might fail at the most inopportune time.

Side release buckles are disclosed, for example in Frano et al. U.S. Pat. No. 5,222,279. While buckles such as that disclosed by Frano et al. are serviceable and generally reliable, they do not provide particularly for high security in the types of use which have been mentioned above.

Crowle U.S. Pat. No. 4,912,950 discloses a side release buckle including a locking mechanism which can prevent the buckle from being released, but while such a device provides for high security, it is impractical where release may also be required with short notice, as in police or military uses.

Other buckles are known in which a center, front release mechanism is provided, as disclosed in Bakker et al. U.S. Pat. No. 4,398,324, for example. Such buckles, however, have rather large movable release elements, making it easy to release such buckles.

Additionally, buckles which combine some of the aspects of a center release mechanism with some of the aspects of a side release buckle are known, as shown in Wolterstorff, Jr. U.S. Pat. No. 4,825,515 which shows a third latch on a side release buckle. The buckle disclosed by Wolterstorff, Jr., however, is undesirably awkward to use because a third latch is engaged in a slot in one edge of the female portion of the buckle, and, because of that location of the third latch, it is possible for a web belt held by the buckle to interfere with the latch, possibly releasing it unintentionally.

What is needed, therefore, is an improved buckle for use on web belts, providing higher security in certain applications, and less susceptible to accidental release and disengagement of its parts from each other.

SUMMARY OF THE INVENTION

The present invention overcomes the aforementioned shortcomings and drawbacks of the prior art side release and front release buckles and provides an improved buckle providing improved security along with convenient use for interconnecting items ordinarily held in tension, such as the opposite ends of a belt. The present invention provides a buckle having a male part that includes three latch elements which all mate individually with a female part. Two of the latches are carried on a pair of side release latch arms, and a third is carried in a centrally-located latch arm. A side release body on each side release arm includes a movable catch to engage a fixed catch located on a corresponding side of the female part, and a push-button release for the third latch is accessible in a latch receptacle located in a front wall of the female part of such a buckle.

Release of such a buckle requires inward movement of the two side release bodies and the third, or central, release push button, and thus requires pressures in three different directions. All three of the latches must be released simultaneously to disengage the male and female parts of the buckle from each other.

In a preferred embodiment of the invention the centrally-located, third latch push button is located on a front wall of a tubular body of a female part of the buckle, where it protrudes no more than a very small distance, but still can be felt easily so that it can be pressed to unfasten the buckle. The third latch push button does not protrude enough nor cover a large enough portion of the front wall of the buckle so as to be likely to be inadvertently pushed far enough to release the central latch.

In a preferred embodiment of the invention a pair of side release arms of the male part of the buckle cooperate with catches located within the tubular body of the female part of the buckle in a manner similar to that disclosed in Frano et al. U.S. Pat. No. 5,222,279.

In one embodiment of the invention both the female part and the male part of the buckle are molded of a strong and resiliently flexible plastics material.

In a preferred embodiment of the invention, the third latch push button and the associated latch receptacle are of a minimum size consistent with easy operation in order to reduce likelihood of undesired release.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
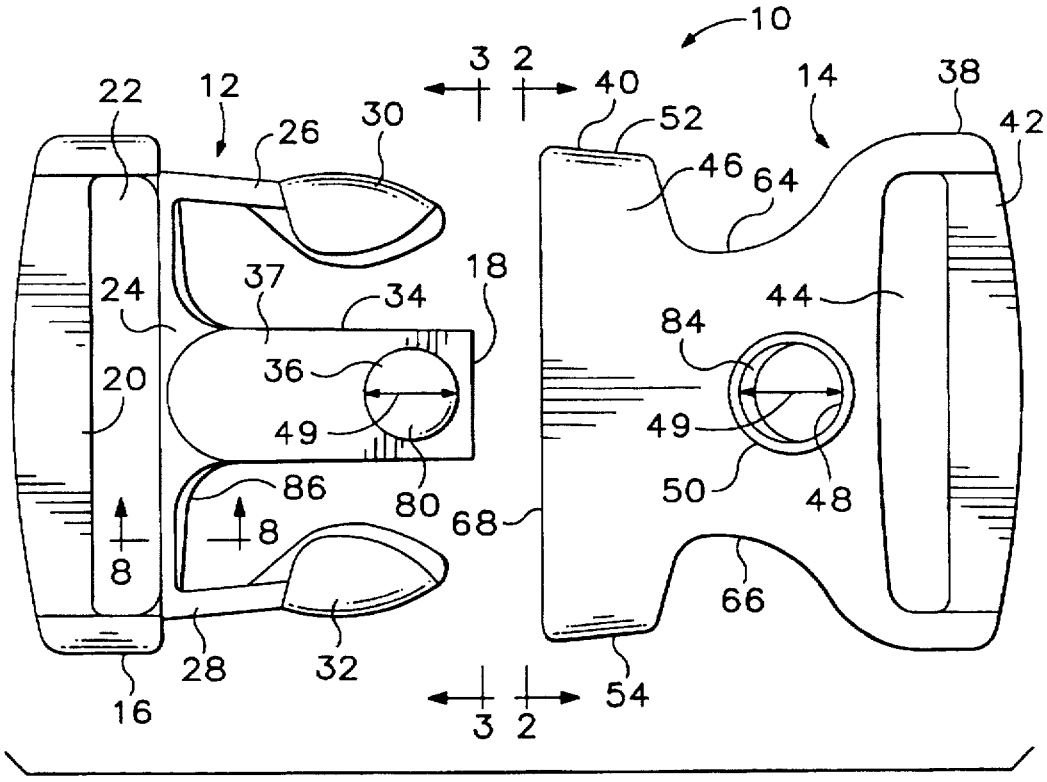
FIG. 1 is a view of the two parts of a buckle according to the present invention, spaced apart but aligned with each other, ready to be mated with each other.
Figure 2:
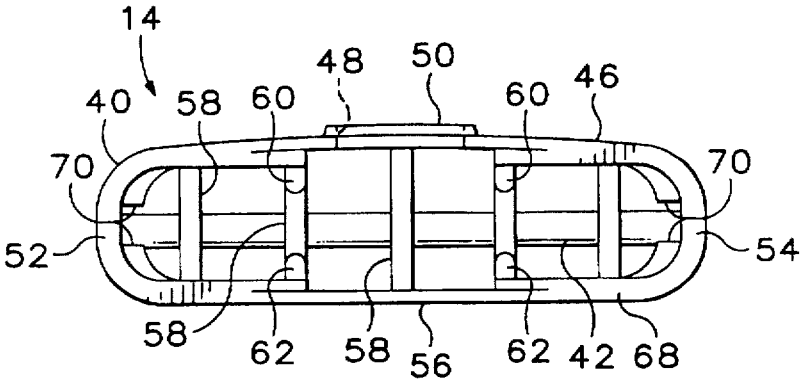
FIG. 2 is a view taken in the direction indicated by the line 2—2 in FIG. 1, showing the female part of the buckle as seen from its open receiving end.

Referring now to the drawings which form a part of the disclosure herein, a buckle 10 has a male part 12 and a female part 14, shown spaced slightly apart from each other but aligned ready to be engaged with each other, in FIG. 1. Both of the parts are preferably of molded plastic construction and may be made using conventional materials and techniques.

The male part 12 has a base 16 and an opposite leading end 18. A bar 20 extends transversely in the base 16 and is available to receive a web belt or the like wrapped about the bar 20 and extending through a slot 22 located alongside the bar 20.

A transversely extending portion 24 of the base 16 defines the other side of the slot 22. Extending from the transversely extending portion 24 toward the leading end 18 of the male part 12 are a pair of side release latch arms 26 and 28 located on respective opposite sides of the base 16, each attached to and supporting a respective catch body 30, 32, located at the leading end 18 of the male part 12.

A central latch arm 34 also extends toward the leading end 18, from a position at the middle of the transversely extending portion 24, and a third catch body 36 is located on a front side 37 of the central latch arm 34.

The female part 14 has a base 38 and a tubular body 40. The base 38 includes a bar 42 similar to the bar 20 of the male part 12 and defines a slot 44 alongside the bar 42 to receive a web belt or the like.

The body 40 includes a front wall 46 that defines a latch receptacle 48 in the form of an opening extending through the front wall 46 at a location spaced apart from the base 38 by a distance great enough that the latch receptacle is entirely surrounded by material of the front wall 46. The latch receptacle 48 and the third catch body 36 have diameters 49 of a large enough size to be found by touch and pushed easily, yet not so large as to be pushed without a deliberate attempt, and the latch receptacle 48 is large enough to allow the catch body 36 to enter it freely. A diameter 49 in the range of about ⅞ inch to ¾ inch is satisfactory and about ½ inch is preferred. A rim 50 stands proud of the front wall 46, surrounding the latch receptacle 48 on the outside of the body 40 of the female part 14.

A top side 52 and a bottom side 54 of the tubular body 40 interconnect the front wall 46 with a rear wall 56. Several small posts 58 spaced along the base of the female part 14 interconnect the front wall 46 and the rear wall 56. Two ribs 60 extend longitudinally of the tubular body 40, along the interior surface of the front wall 46 and two opposite ribs 62 extend longitudinally along the rear wall 56.

Figure 4:
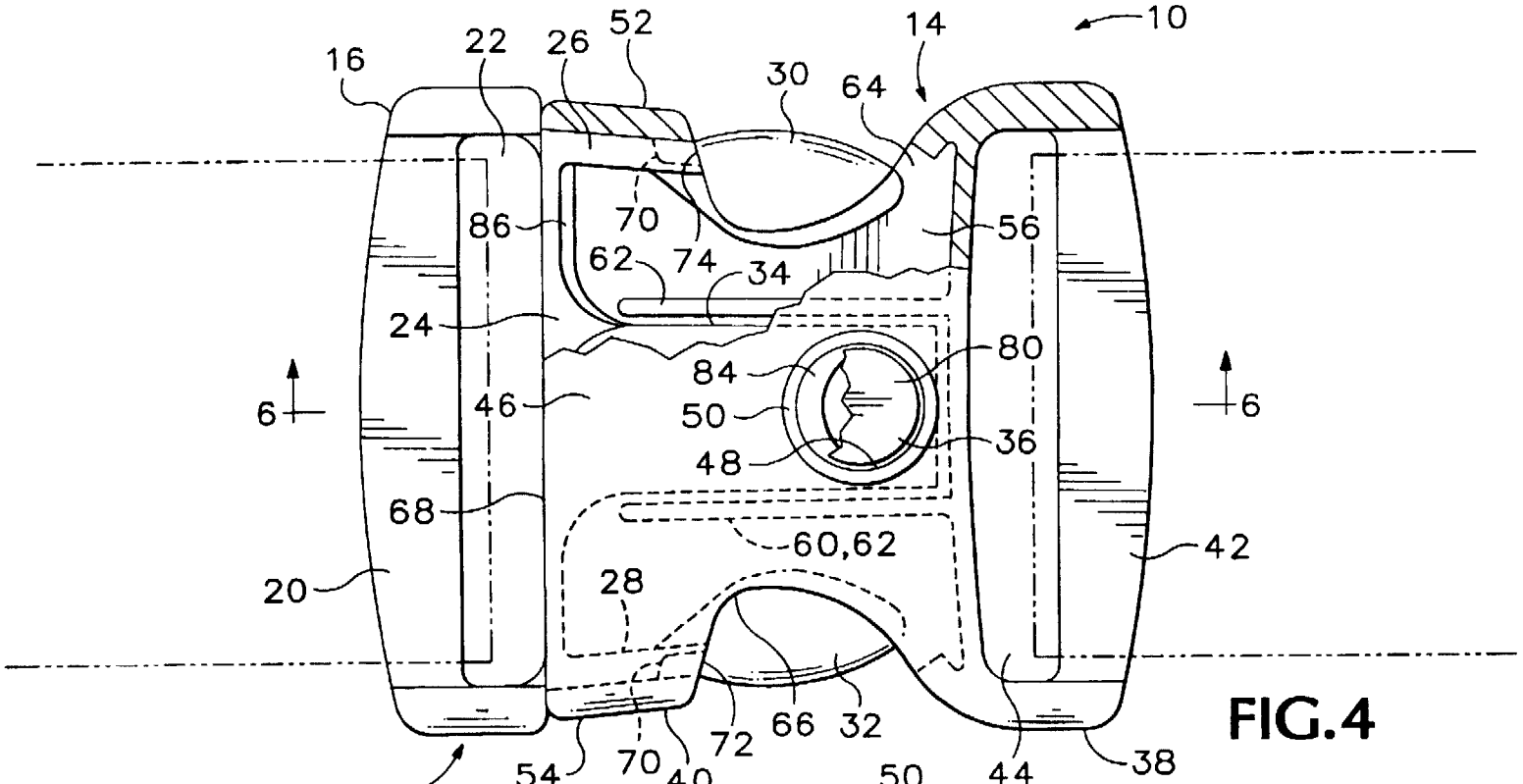
FIG. 4 is a partially cut-away front elevational view of the buckle shown in FIG. 1, with the male and female parts thereof mated with each other.
Figure 5:
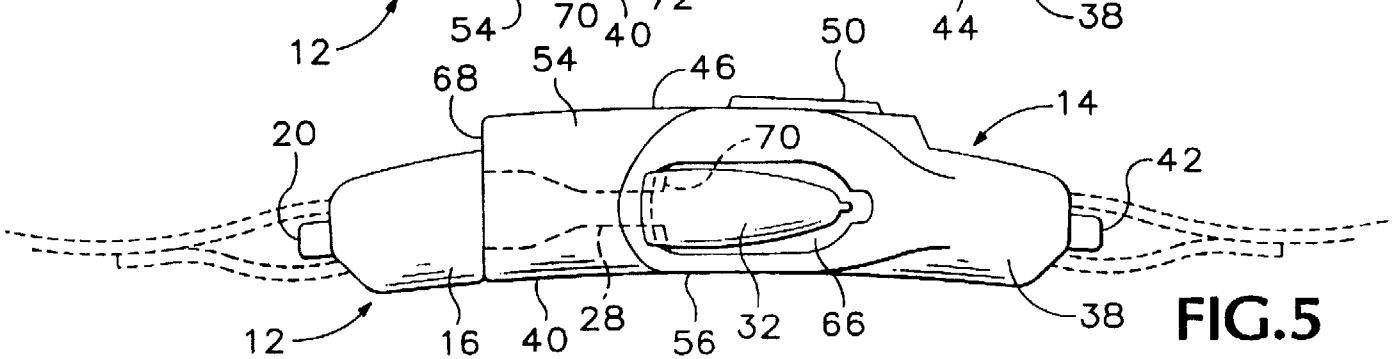
FIG. 5 is a bottom side view of the buckle shown in FIG. 1 with the male and female portions mated with each other.

Respective openings 64, 66, large enough to expose the side release catch bodies 30 and 32, are defined in the top and bottom sides 52, 54, a distance away from the receiving end 68 of the tubular body 40. A pair of fixed catches 70 are located inside the tubular body 40 adjacent each of the openings 64, 66, between the openings 64, 66 and the receiving end 68. Each of the catches 70 includes an engagement surface 72 facing toward the base of the female part 14, and engagement surfaces 74 located on the catch bodies 30, 32 rest on the engagement surfaces 72 when the buckle 10 is fastened, that is, when the male part 12 and female part are mated as shown in FIGS. 4 and 5. Engagement of the catch bodies 30, 32 with the female part 14 of the buckle 10 is thus similar to the engagement of the male and female parts of the buckle disclosed in Frano et al. U.S. Pat. No. 5,222,279 and helps to keep the male part 12 securely fastened to the female part 14. It will be understood, however, that the invention is not limited to the type of side release latch mechanism described in the previously mentioned Frano et al. U.S. Pat. No. 5,222,279, since the combination of a pair of side release latches together with a third catch located on a central latch arm is also feasible with other types of side release latch mechanisms.

The central latch arm 34 extends generally parallel with the side release latch arms 26 and 28 toward the leading end 18 of the male part 12 of the buckle and also fits within the body 40 of the female part 14 of the buckle, between the ribs 60 which extend along the inner sides of the front wall 46 and back wall 56. The third catch body 36 protrudes forward from the front face 37 of the central latch arm 34, and resides in the latch receptacle 48 when the male and female parts 12, 14 are mated with each other. The height 79 of the central latch arm 34 and the third catch body 36 (FIGS. 3, 7) is small enough to fit between the interior surfaces of the front wall 46 and the rear wall 56, but when the male part 12 is in its usual undistorted configuration the side release arms 26 and 28 are aligned alongside the central arm 34 so that the central or third catch body interferes with insertion of the male part 12 into the open receiving end 68 of the body 40.

Figure 3:
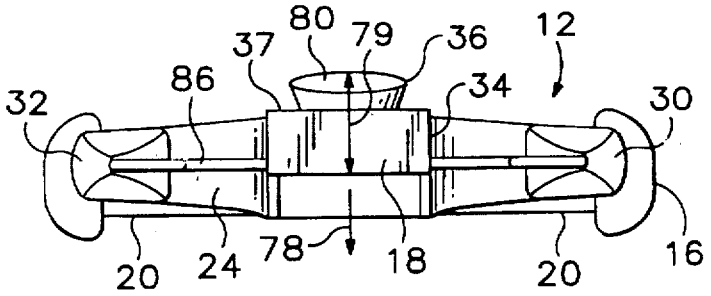
FIG. 3 is a view taken in the direction indicated by line 3—3 in FIG. 1, showing the male part of the buckle as seen from its leading end.

In fastening the buckle 10, then, as the male part 12 is inserted within the tubular body 40, the central latch arm 34 is moved with respect to the side release latch arms 26 and 28, in the direction of the arrow 78 shown in FIG. 3. This distortion of the male part 12 takes place as a result of cam action when the leading end 18 of the male part 12 is pushed into the receiving end 68 of the tubular body 40 of the female part 14, partly as a result of the pointed, tapered shape of each of the catch bodies 30, 32, and in part because of the orientation of the convex top surface 80 of the third catch body 36. As the male part 12 is inserted into the female part 14, then, the top surface 80 of the third catch body 36 presses outward against the interior surface of the front wall 46, and the rear surfaces of the catch bodies 30 and 32 press against the rear wall 56, and the male part 12 flexes resiliently to fit within the tubular body 40 as shown in FIG. 7 until the third catch body 36 becomes aligned with and is then urged upward into the latch receptacle 48 defined by the front wall 46 to the position shown in FIG. 6. Simultaneously, the side release latch arms 26, 28 are bent toward each other as the catch bodies 30, 32 move along the interior surfaces of the top and bottom sides 52, 54 and along the associated catches 70 as the male part 12 is urged into the tubular body 40. At the proper position of the male part 12 within the tubular body 40, each of the engagement surfaces 74 is substantially simultaneously able to engage a respective engagement surface 72 of one of the catches 70, as the side release arms 26, 28 proceed past the catches 70.

Figure 6:
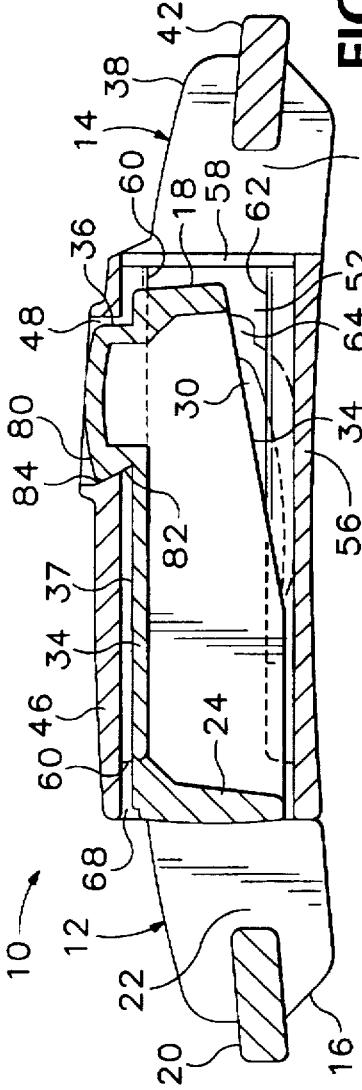
FIG. 6 is a sectional view of the buckle shown in FIG. 1, taken along line 6—6 of FIG. 4.
Figure 7:
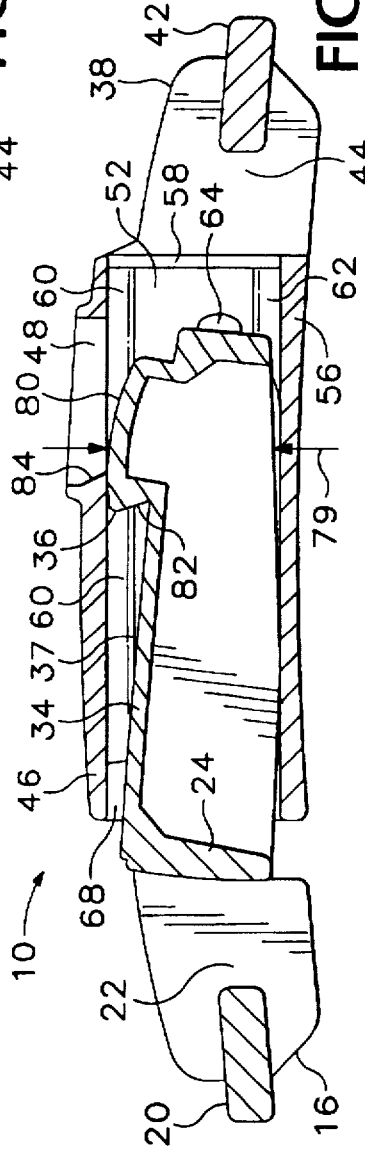
FIG. 7 is a view similar to FIG. 6, but showing the buckle with the male part slightly less than fully inserted into the female part.

Preferably, the third catch body 36 includes a reversely inclined engagement surface 82, angled outwardly and toward the base 16, and a correspondingly inclined second engagement surface 84 is defined by the latch receptacle 48, as shown in FIGS. 6 and 7. As a result, forces tending to separate the male part 12 from the female part 14, such as tension in web belts attached to the bars 20 and 42, can act along the engagement surfaces 82 and 84 and urge the central latch arm 34 toward the front wall 46. This, in turn, urges the third catch body 36 into more intimate engagement within the latch receptacle 48 at the same time the side release catch bodies 30 and 32 are urged into more secure and intimate engagement with the catches 70.

With the central latch arm 34 in its normal relaxed condition, as when there is no tension in web belts attached to the buckle 10, the third catch body 36 is kept in position within the latch receptacle 48, with the top surface 80 of the third catch body 36 exposed as a latch release push button on the outside of the front wall 46 of the tubular body 40, but located flush with or slightly behind the outer face of the rim 50.

To release the male part 12 from engagement with the female part 14 the two side release latch arms 26, 28 must be flexed toward each other by pressing inward on the catch bodies 30 and 32 to release the engagement surfaces 74 from the respective engagement surfaces 72 of the catches 70 in the manner well known in releasing side release buckles. Additionally, pressure must be applied on the top surface 80 of the third catch body 36 at the same time to move the third catch body 36 toward the rear wall 56 far enough to disengage the third catch body 36 from the latch receptacle 48. As a result of this requirement to disengage three separate latches simultaneously, accidental inward pressure against one or even both of the catch bodies 30 or 32 is insufficient to release the male part 12 from engagement with the female part 14 of the buckle 10. In most cases, once pressure on the side release catch bodies 30 and 32 is relaxed, if the force tending to separated the male and female parts is also relaxed, the elastic forces in the male part 12 tend to reengage the side release latches that have been inadvertently disengaged.

Figure 8:
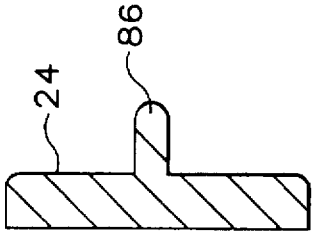
FIG. 8 is a section view, taken along line 8-8 of FIG. 1.

In a preferred embodiment of the invention, the pressure required against the top surface 80 to disengage the third catch body 36 from the latch receptacle 48 should be about eight pounds, although a force requirement in the range of about 6 pounds to about 12 pounds is satisfactory. This pressure, it will be understood, will result in twisting of the transverse portion 24 on either side of the central latch arm 34 or elastic flexure of the central latch arm 34. Preferably, the transverse portion 24 includes a web 86 to provide some additional strength to resist tension in the central latch arm, as shown in FIG. 8.

Figure 9:
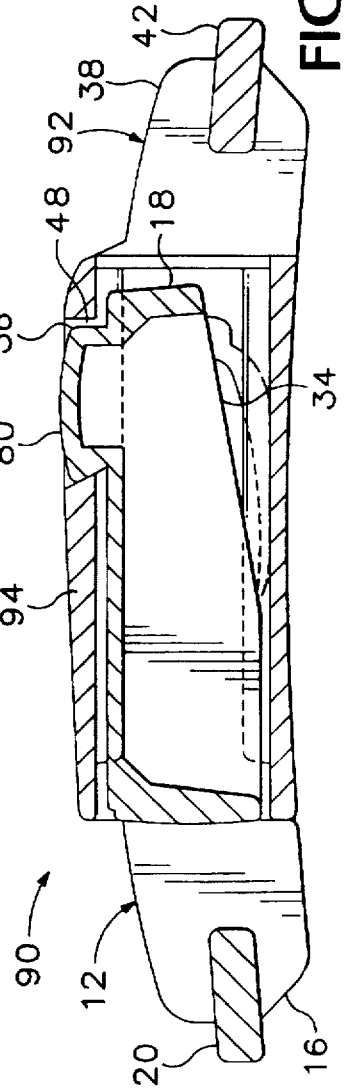
FIG. 9 is a view similar to FIG. 6, showing a buckle according to the invention including a slightly different female part.

As shown in FIG. 9, a buckle 90 which is generally similar to the buckle 10 differs slightly, in that it includes a female part 92 having a front wall 94 that is smoothly faired around the latch receptacle 48, thus lacking the rim 50 provided in the female part 14 of the buckle 10. In the buckle 90 the third catch body 36 protrudes slightly forward, proud of the front wall 94 by a small distance, about 0.050 inch, for example, to facilitate finding the third catch body 36 by touch without it being likely to be pushed unintentionally.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A high-security buckle, comprising:

(a) a male part having a base and a leading end, including a pair of laterally apart-spaced side release latch arms extending toward said leading end, each side release latch arm including a respective catch body, and a central latch arm having a third catch body located thereon, said side release latch arms being resiliently flexible toward each other; and (b) a female part having a base and a tubular body including an open receiving end, said female part including a front wall, an opposite back wall, and a pair of opposite top and bottom sides, said top and bottom sides each defining an opening and said female body having a fixed catch associated with each of said openings and engaging the catch body of a respective one of said side release arms, said front wall defining a latch receptacle that is fully surrounded by but open through said front wall of said female part, and said third catch body extending into said latch receptacle, said third catch body having a top surface that is exposed through said front wall of said female part when said buckle is fastened, and said side release latch arms and said central latch arm being free from mechanisms interacting with each other, whereby disengagement of said male part from said female part requires simultaneous inward pressure on both of said side release catch bodies and on said top surface of said central latch arm, sufficient to move both of said side release catch bodies out of engagement with said fixed catches and to move said third catch body out of engagement with said latch receptacle.

2. The high-security buckle of claim 1 wherein said third catch body protrudes forward from said central latch arm and includes a reversely inclined engagement surface, and wherein said latch receptacle includes a correspondingly inclined second engagement surface whereby a force tending to withdraw said male part from engagement with said female part urges said third catch body into more intimate engagement in said latch receptacle.

3. The buckle of claim 1 wherein said female part includes a forwardly protruding rim located on said front wall and surrounding said latch receptacle.

4. The buckle of claim 1 wherein said male part includes a transversely extending portion and said central latch arm extends from said transversely extending portion toward said leading end of said male part, said central latch arm being movable with respect to said side release latch arms.

5. The buckle of claim 4 wherein said transversely extending portion is twisted resiliently about an axis generally parallel with said transversely extending portion by movement of said third central latch arm.

6. The buckle of claim 1 wherein said latch receptacle is generally circular and no greater than 0.75 inch in diameter.

7. The buckle of claim 6 wherein said latch receptacle is about 0.5 inch in diameter.

* * * * *